US008055149B2

(12) United States Patent
Kwak

(10) Patent No.: US 8,055,149 B2
(45) Date of Patent: Nov. 8, 2011

(54) CHARGING DEVICE FOR USING SCOROTRON CHARGING MECHANISM AND IMAGE FORMING DEVICE COMPRISING THE CHARGING DEVICE

(75) Inventor: Jun-suk Kwak, Gwangju-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 50 days.

(21) Appl. No.: 12/481,969

(22) Filed: Jun. 10, 2009

(65) Prior Publication Data

US 2010/0092203 A1 Apr. 15, 2010

(30) Foreign Application Priority Data

Oct. 14, 2008 (KR) ..... 10-2008-0100594

(51) Int. Cl.
*G03G 15/20* (2006.01)

(52) U.S. Cl. ..... 399/89

(58) Field of Classification Search ..... 399/88, 399/89, 170–173
See application file for complete search history.

(56) References Cited

U.S. PATENT DOCUMENTS 4,432,631 A * 2/1984 Bacon et al. ..... 399/148
7,254,349 B2 8/2007 Kamiya
2005/0200309 A1 9/2005 Kamiya

FOREIGN PATENT DOCUMENTS

JP 2005-189355 7/2005

OTHER PUBLICATIONS

English abstract of JP-2005-189355.
Machine English language translation of JP-2005-189355.

* cited by examiner

*Primary Examiner* — Hoang Ngo
(74) *Attorney, Agent, or Firm* — Staas & Halsey LLP

(57) ABSTRACT

A charging device is provided. The charging device includes a shield, a discharging part disposed inside the shield, a grid formed at an open end of the shield. The charging device further includes a power supply unit supplying charging power while maintaining the voltage difference between the discharging part and the grid at a predetermined level.

10 Claims, 11 Drawing Sheets

CHARGING DEVICE FOR USING SCOROTRON CHARGING MECHANISM AND IMAGE FORMING DEVICE COMPRISING THE CHARGING DEVICE

CROSS-REFERENCE TO RELATED PATENT APPLICATION

This application claims priority under 35 U.S.C. §119 from Korean Patent Application No. 10-2008-100594, filed on Oct. 14, 2008, in the Korean Intellectual Property Office, the disclosure of which is incorporated herein by reference in its entirety.

TECHNICAL FIELD

Apparatuses and methods consistent with the present disclosure relate to a charging device and an image forming device employing the same, and, more particularly, to a charging device including a scorotron charging mechanism and an image forming device utilizing the same with an improved charging efficiency.

BACKGROUND OF RELATED ART

With the development of electronic technology, computer peripheral devices and office equipment have seen a recent rapid technological advancements. One representative product with rapid advancement is an image forming device.

An image forming device is a device that forms an image or image data on a printing medium or a recoding medium, may include such devices as, e.g., a printer, a copy machine, a fax machine, a multi-function printer, or the like.

An image forming device is capable of forming an image in various ways, one of which ways may include the use of an electrophotography mechanism.

In order to form an image, the electrophotography mechanism follows the process of charging the surface of photoconductor, forming a latent image through exposure, developing the latent image with a toner, transferring a developed toner image to a printing medium, and fusing the image on the printing medium.

In such an electrophotography mechanism, a charging device is typically used to charge the surface of a photoconductor to a predetermined electrical charge. The charging device may be manufactured in various ways. Recently, a charging device for corona charging mechanism device using a pin scorotron has been developed and used.

Such charging device typically includes a shield, a grid, and a pin disposed inside the shield, and induces corona discharge from the pin by connecting a predetermined electrical power from a power source to the pin and the grid. The grid is disposed in proximity of the photoconductor so as for the electrical charge discharging from the pin to be transferred to the surface of the photoconductor.

When using a pin scorotron discharging mechanism, an extra electrical current (margin) is typically added to the corona voltage (or electrical current) in order to ensure sufficient electrical current discharge from the pin to guarantee proper charging level.

However, if the current margin becomes excessive, the effectiveness of voltage may be reduced, oxidation of the pin and/or the grid may accelerate, and a greater amount may possibly be generated. Such oxidation of the pin and/or the grid, or contamination by ozone of the toner may compromise the charging uniformity.

There is thus a need for a charging device with improved control of the charging electrical potential, which may better correspond to the developing conditions, and for an improved method of controlling electrical power source.

SUMMARY OF THE DISCLOSURE

According to one aspect of the various embodiments of the present disclosure, there is provided a charging device which controls electrical power source supplied to at least one of a grid and a discharging part appropriately to improve image quality, and/or to reduce contamination by, e.g., ozone or other causes.

According to the exemplary embodiment of the present invention, a charging device may comprise a shield, a discharging part disposed inside the shield, a grid formed at an entrance of the shield and a power supply unit that supplies power so that a voltage difference between the discharging part and the grid can be a predetermined level.

The power supply unit may include a power source connected to the discharging part and a diode. One end of the diode may be connected to a first connection node between the discharging part and the power source unit. The other end of the diode may be connected to a second node between the grid and ground, thereby keeping the predetermined voltage difference between the discharging part and the grid.

The power supply unit may include a first power source connected to the grid, a second power source unit connected to the discharging part and a power source controller, which controls the first power source unit so that the voltage applied to the grid becomes a target value, and which controls the second power source unit so that the voltage applied to the discharging part maintains the predetermined voltage difference from the voltage of the grid.

The discharging part may have one of the shapes among wire, pin and saw teeth.

The voltage difference between the discharging part and the grid may be within a range of ±3.8 kV to ±6.0 kV.

The electrical current of the discharging part may be within a range of ±400 μA to ±2000 μA.

According to another aspect, an image forming device may comprise a photoconductor and a charging device which charge a surface of the photoconductor. The charging device may comprise a shield, a discharging part disposed inside the shield, a grid formed at an entrance of the shield spaced apart from the surface of photoconductor and a power supply unit which supplies power so that the grid would have voltage corresponding to the voltage of the surface of the photoconductor and the discharging part and the grid would have a predetermined voltage difference.

The power supply unit may include a power source connected to the discharging part and a diode. One end of the diode may be connected to a first connection node between the discharging part and the power source unit. The other end of the diode may be connected to a second node between the grid and ground, thereby keeping the predetermined voltage difference between the discharging part and the grid.

The power supply unit may include a first power source connected to the grid, a second power source unit connected to the discharging part and a power source controller, which controls the first power source unit so that the voltage applied to the grid becomes a target value, and which controls the second power source unit so that the voltage applied to the discharging part maintains the predetermined voltage difference from the voltage of the grid.

The discharging part may have one of the shapes among wire, pin and saw teeth.

The voltage difference between the discharging part and the grid may be within the range of ±3.8 kV to ±6.0 kV. The electrical current of the discharging part may be within the range of ±400 μA to ±2000 μA.

BRIEF DESCRIPTION OF THE DRAWINGS

Various aspects of the present disclosure will become more apparent and more readily appreciated from the following description of the embodiments, taken in conjunction with the accompanying drawings, in which.

DETAILED DESCRIPTION OF SEVERAL EMBODIMENTS

Several embodiments of the present invention will now be described in greater detail with reference to the accompanying drawings.

Figure 1:
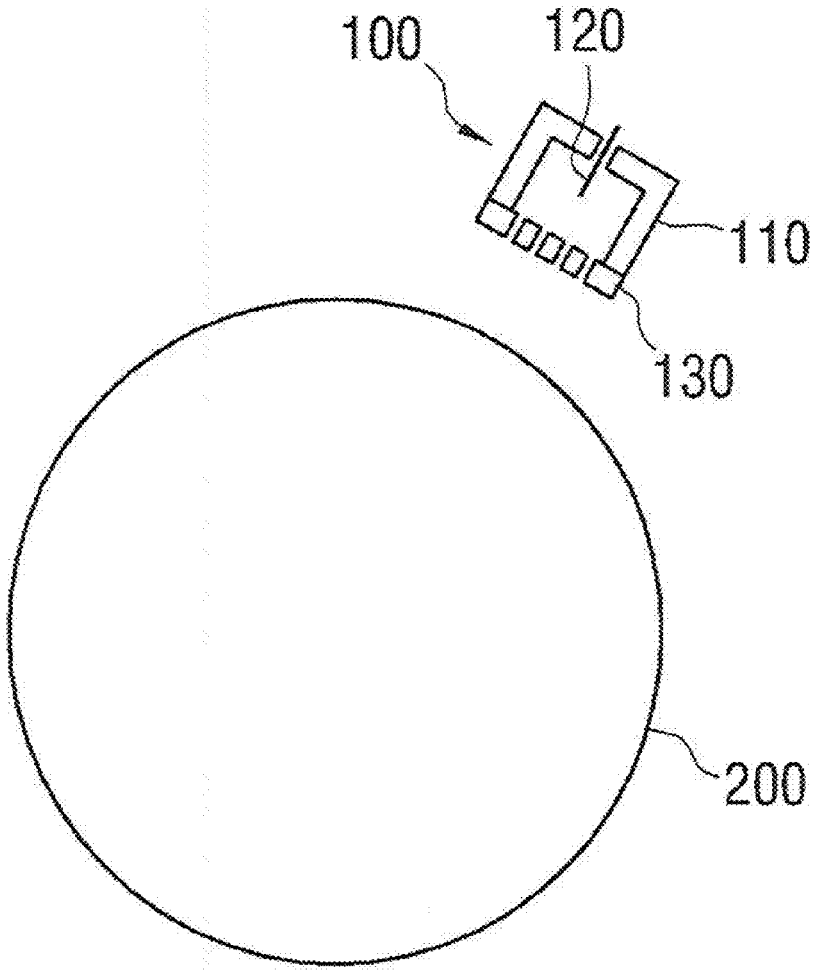
FIG. 1 is a schematic perspective view illustrating an image forming device according to an embodiment of the present invention.

FIG. 1 is a schematic perspective view illustrating an image forming device according to an embodiment. As shown, an image forming device may comprise a photoconductor 200 and a charging device 100. The image forming device in FIG. 1 may be, for example, without limitation, a printer, a copy machine, a fax machine, or a multi-function printer. While, for the sake of brevity, only those components necessary to explain the embodiment are illustrated FIG. 1, it should be noted that other components in addition to those shown may be added.

The surface of the photoconductor 200 may be charged to a predetermined level of electrical charge, and may be used in the exposure, development and/or transfer of images.

The charging device 100 is used in charging the surface of the photoconductor 200 to predetermined amount of charge.

In particular, the charging device 100 may comprise a shield 110, a discharging part 120 and a grid 130.

The shield 110 is disposed spaced apart from the photoconductor 200, proximate to the photoconductor 200. One side of the shield is opened towards the photoconductor 200.

The discharging part 120 is disposed inside the shield 110. The discharging part 120 may be categorized according to the shape of its end into one of a wire, pin, cone and a saw tooth type.

The discharging part 120 is disposed inside the shield 110 with an end of the discharging part 120 extending towards the entrance of the shield 110. According to an embodiment, the discharging part 120 is disposed at a predetermined distance from the sidewalls of the shield 110, for instance, at the center of the shield 110, so that the discharging part 120 would not contact the walls of the shield 110.

The grid 130 is disposed at the entrance of the shield 110. The grid 130 may comprise, e.g., a mesh configuration, and may output electrical charge onto the photoconductor 200 as corona discharged from the discharging part 120 hits the grid 130. Accordingly, the surface of the photoconductor 200 may be charged by the output electrical charge.

Figure 6:
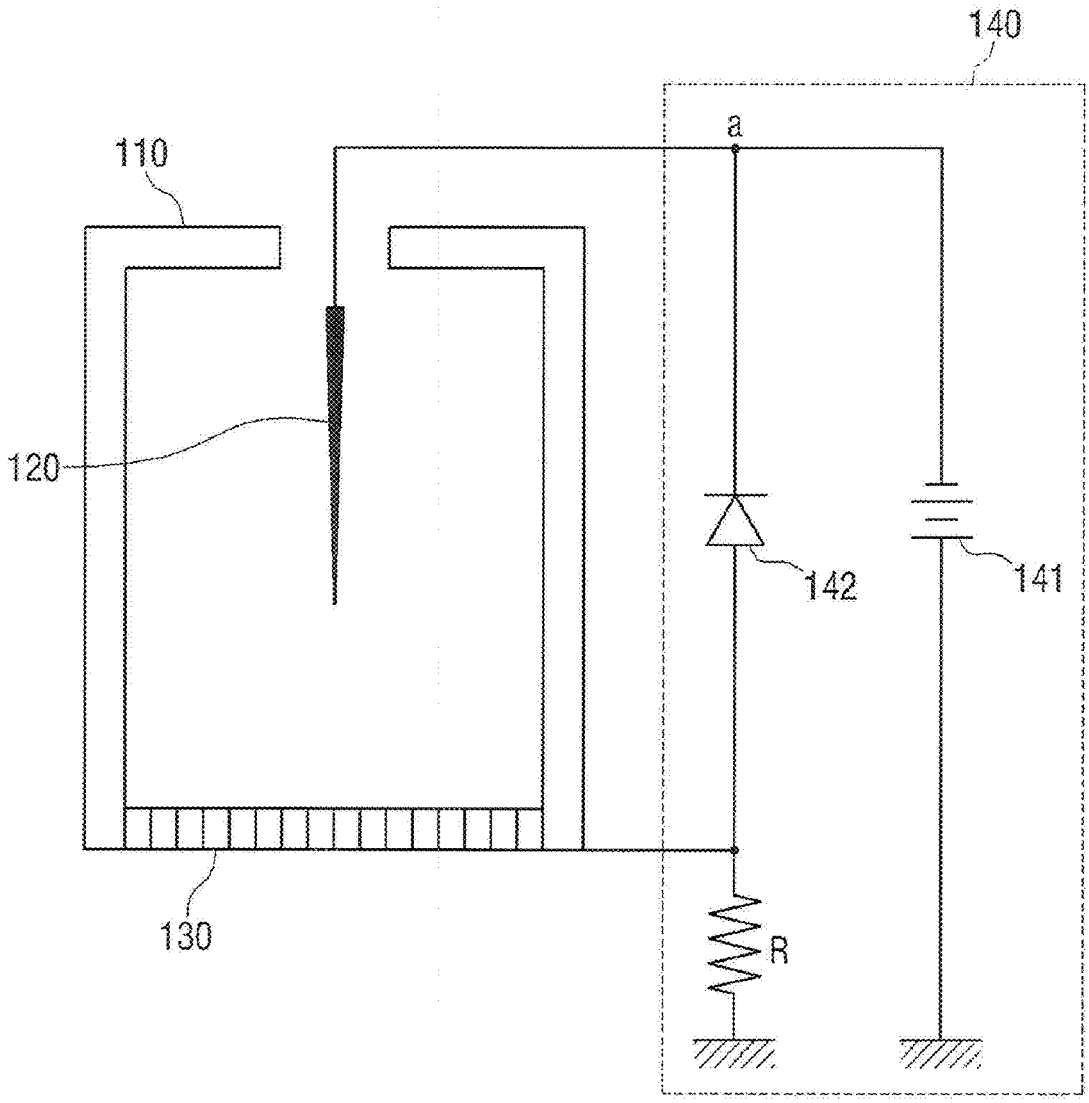
FIG. 6 is a schematic perspective view illustrating a charging device according to an embodiment.

The charging device 100 or an image forming device may further comprise a power supply unit 140 (e.g., as shown in FIG. 6). The power supply unit 140 supplies electrical power to at least one of the discharging parts 120 and the grids 130 so that the discharging part 120 and the grid 130 have predetermined electrical potential difference between them.

In the case of an image forming device using electrophotography mechanism, in addition to the charging device 100, a laser scanning unit (not shown), a developing unit (not shown), and transfer device (not shown) may also be disposed around the photoconductor 200. Each device may appropriately provided with driving voltage that correspond to the designed or intended operation of the particular electrophotography mechanism, and may be driven accordingly.

For example, in the case of an image forming device using two-component toner, there may be predetermined electrical potential difference between the photoconductor 200 and developing device(s) (e.g., a development roller(s)) in order to apply only the toner particle on the surface of the photoconductor 200.

The voltage on the surface of the photoconductor 200 thus needs to be controlled to an appropriate level, which may be accomplished by adjusting the voltage at the grid 130. As the grid 130 charges the surface of the photoconductor 200 by being in the proximity of the photoconductor 200, by applying a predetermined amount of electrical current to the grid 130, the surface of the photoconductor 200 can be made to exhibit the same voltage as the grid 130. Consequently, it is possible to adjust voltage on the grid 130 so as to achieve, e.g., the desired electrical potential difference between the photoconductor 200 and a developing device.

According to an embodiment, when the developing voltage is controlled, grid voltage may be adjusted accordingly. Further, by maintaining the voltage difference between the grid voltage 130 and the discharging part 120 at a certain value, the efficiency of the electrical current can be maximized.

Figure 2:
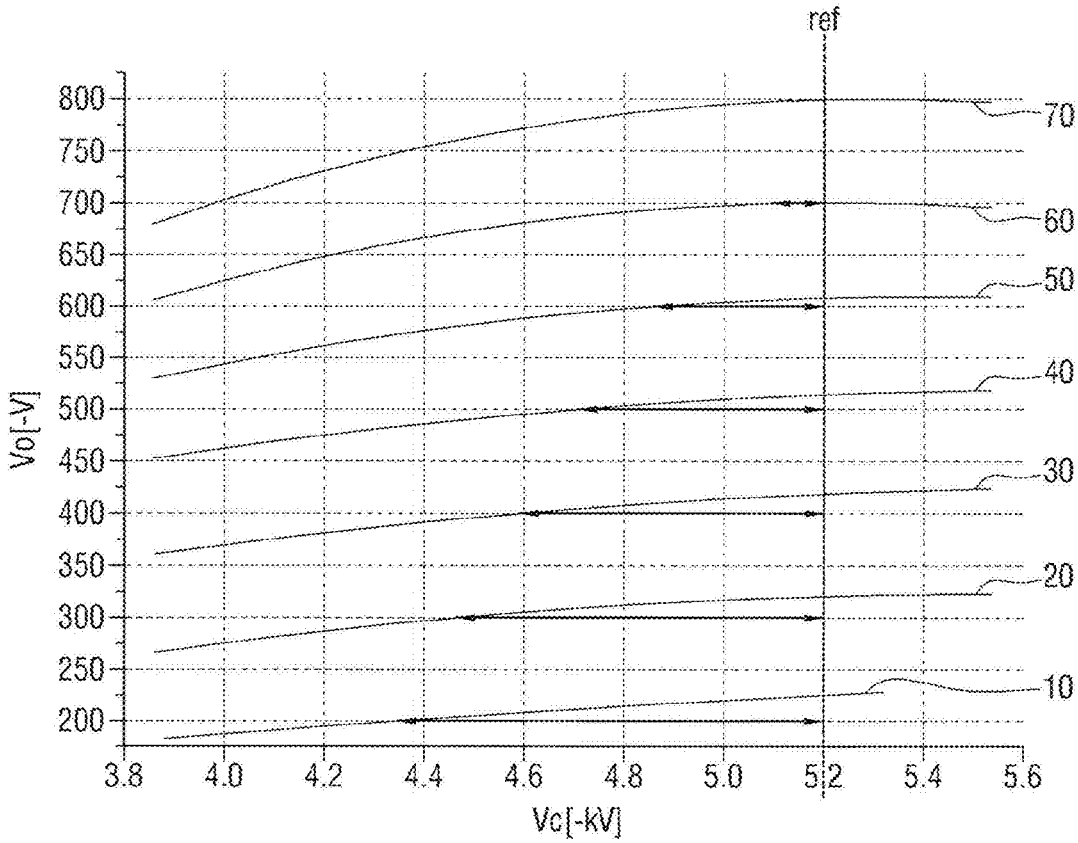
FIG. 2 is a graph showing power loss and discharging efficiency of a conventional charging device.

FIG. 2 is a graph provided to explain the power efficiency of an image forming device employing a conventional charging device.

In FIG. 2, the horizontal-axis represents the voltage of the discharging part 120, i.e., the corona voltage Vc while the vertical-axis represents voltage of the surface of the photoconductor 200, Vo. Each of the curves 10 to 70 plots the grid voltage Vg of the grid 130.

Generally, for a conventional charging device, the charging voltage may be set at a value beyond the point of saturation. For example, in the example shown in FIG. 2, if Vc is −5.2 kV, and if Vg is −800V, Vo also becomes −800V as illustrated by the curve 70. If Vc is fixed at −5.2 kV, more electrical current may be discharged because the absolute value of the surface voltage of photoconductor, Vo, needs to be higher than the absolute value of Vg. Accordingly, power loss occurs as shown in curves 10 through 70 as much as the portion indicated by the double headed arrow lines. Therefore, discharging efficiency may be reduced, and/or extra ozone may be generated.

Figure 3:
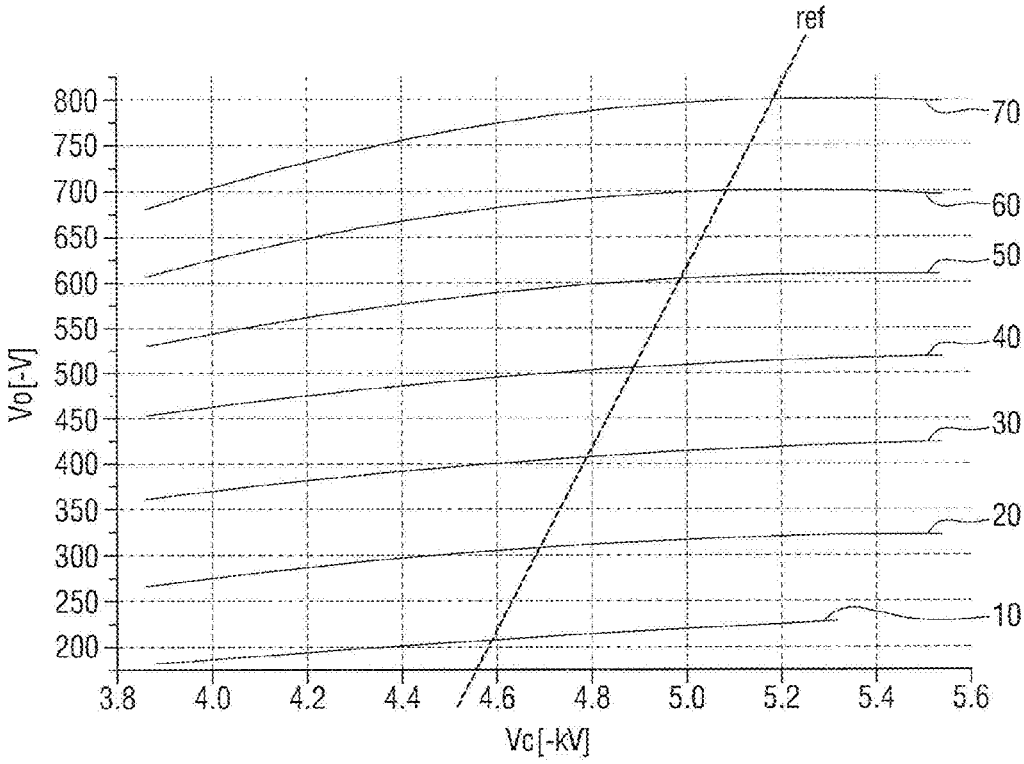
FIG. 3 to FIG. 5 are graphs showing power loss and discharging efficiency of a charging device according to an embodiment.

FIG. 3 is a graph provided to explain the voltage efficiency of an image forming device using a charging device according to one or more embodiments of the present invention.

According to embodiments described above, if the voltage difference between the grid and the discharging part is set at a certain value, for example, at 4.35 kV, Vg substantially equals Vo in each graph, even though extra electrical current is not applied to the discharging part 120. That is, power loss may be reduced compared to the conventional image forming device, and the discharging efficiency may be improved.

Figure 4:
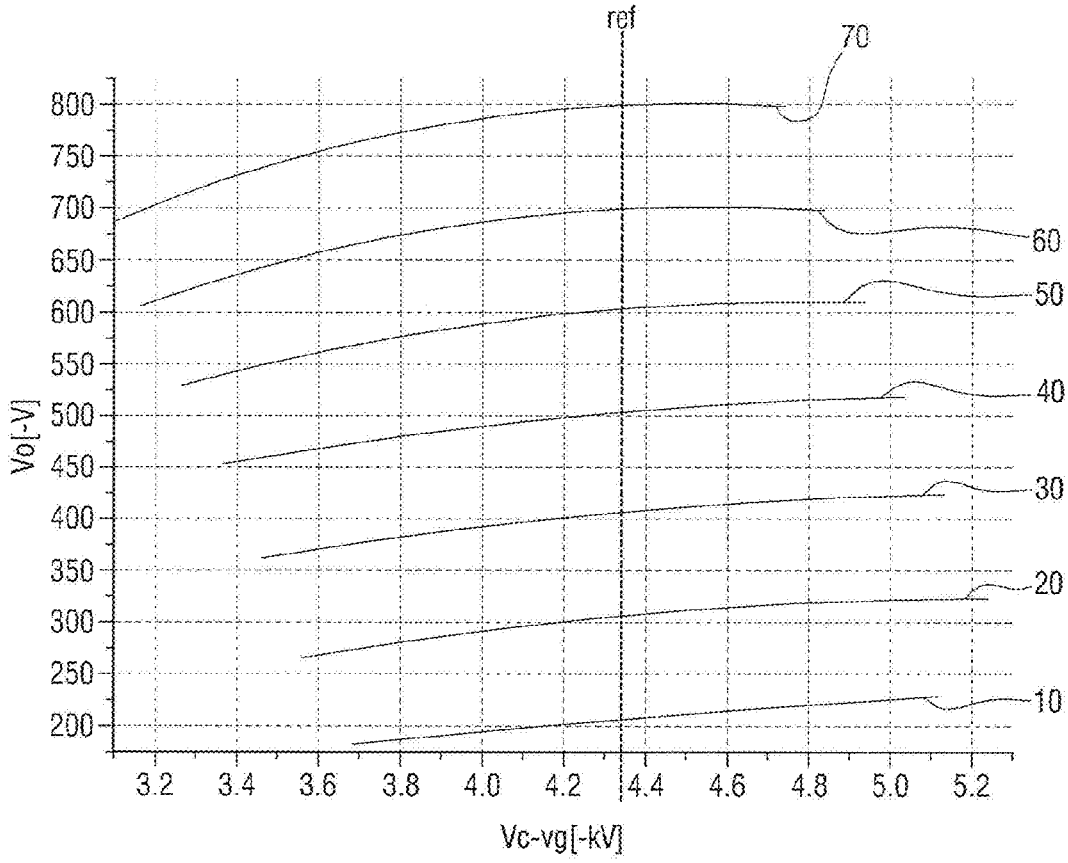

FIG. 4 is another graph provided to explain the voltage efficiency of an image forming device using a charging device according to one or more embodiments of the present invention. In FIG. 4, the horizontal-axis represents Vc-Vg, and vertical-axis represents Vo. In each curve 10 to 70, the point where Vg=Vo is not far apart from the reference marks (ref), which means there has been not much power loss.

Figure 5:
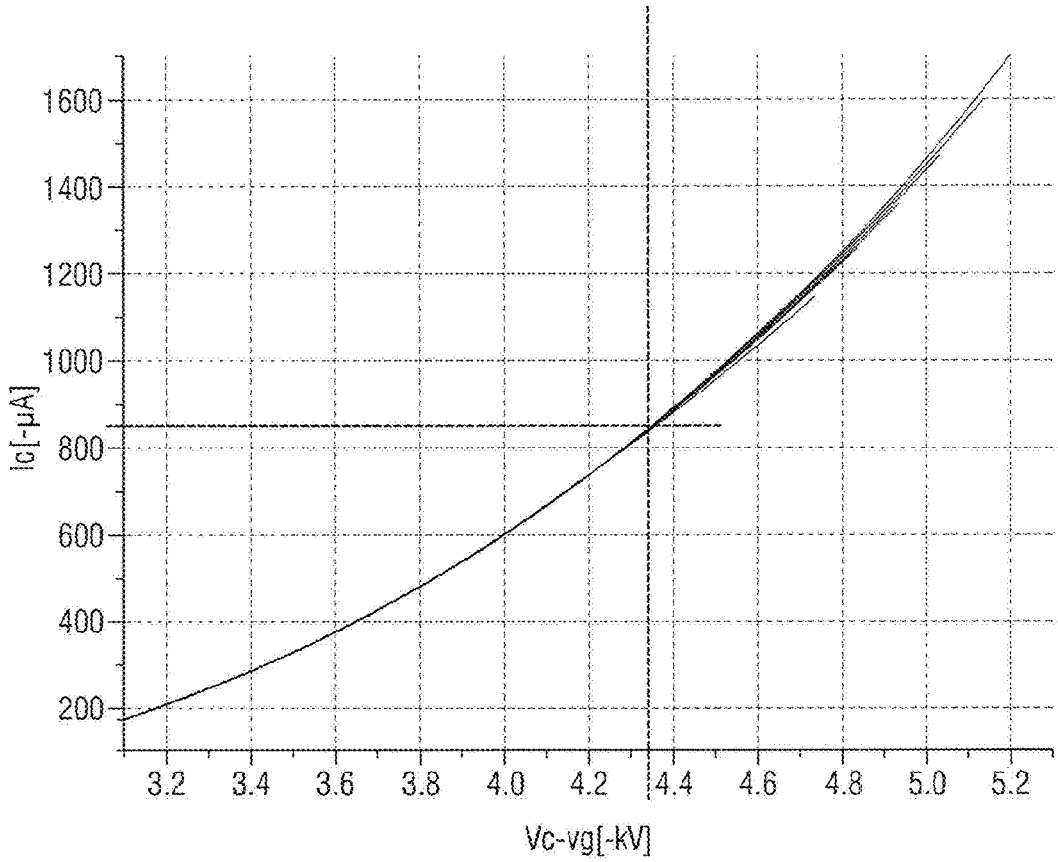

FIG. 5 is another graph provided to explain the voltage efficiency of an image forming device using a charging device according to one or more embodiments of the present invention. In FIG. 5, the horizontal-axis represents Vc-Vg, and the vertical-axis represents Ic which is the electrical current coming into the discharging part 120. It is observed that substantially constant electrical current is present at each Vc-Vg.

Voltage difference between the discharging part 120 and grid 130 may be set empirically. As shown in FIG. 5, if voltage difference is approximately more than 5.2 kV, power loss may be greater due to high current deviation. On the other hand, if voltage difference is less than 3.8 kV, charging capacity may suffer due to poor corona discharging. Therefore, optimum yield may be obtained through experiments.

For instance, voltage difference between the discharging part 120 and the grid 130 may be set within the range of ±3.8 kV to 6.0 kV, and the electrical current of the discharging part 120 may be set within the range of ±400 μA to ±2000 μA.

FIG. 6 is a schematic perspective view illustrating the charging device according to an embodiment of the present invention. The charging device 100 in FIG. 6 comprises the shield 110, the discharging part 120, the grid 130), and the power supply unit 140.

In FIG. 6, the discharging part 120 is disposed inside the shield 110, and is connected to the power supply unit 140. The grid 130 is disposed at the entrance of the shield 110, and is also connected to the power supply unit 140.

The power supply unit 140 may comprise the power source unit 141 and a diode 142. The power supply unit 140 may include one or more resistive elements (R).

The diode 142 connects the connection node "a" between the discharging part 120 and the power source unit 141 and the connection node "b" between the grid 130 and the power source unit 141. Accordingly, if voltage is applied to the discharging part 120, a voltage drop occurs at the diode 142. Consequently, the voltage difference between the discharging part 120 and the grid 130 is set corresponding to the characteristics of the diode 142.

Figure 7:
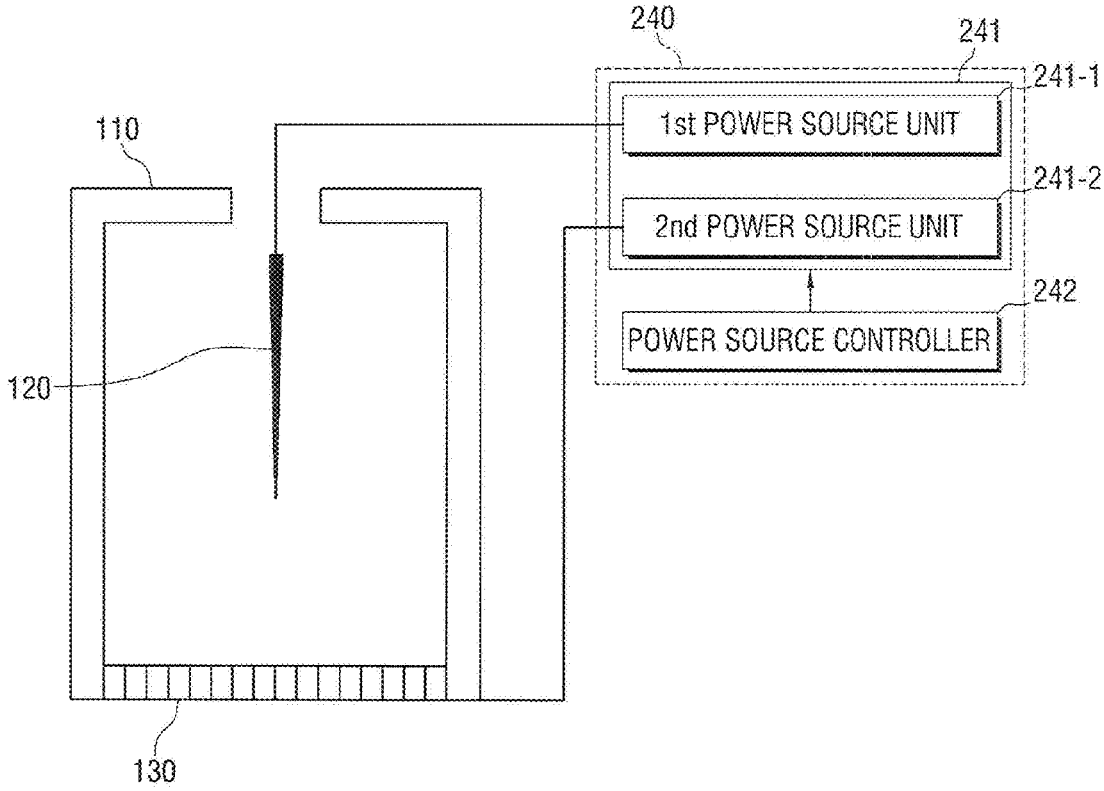
FIG. 7 is a schematic perspective view illustrating a charging device according to another embodiment.

FIG. 7 is a schematic perspective view illustrating a charging device according to an alternative embodiment of the present invention. According to FIG. 7, the charging device may include, in addition to the shield 110, the discharging part 120 and the grid 130, a power supply unit 240 different from the power supply unit illustrated in FIG. 6. As a matter of convenience, the power supply unit in FIG. 7 is given a reference numeral of 240.

The power supply unit 240 in FIG. 7 may comprise a power source unit 241 and a power controller 242. The power source unit 241 may comprise a first power source unit 241-1 and a second power source unit 241-2.

As shown in FIG. 7, the first power source unit 241-1 is connected to the discharging part 120 while the second power source unit 241-2 is connected to the grid 130. The first power source unit 241-1 and the second power source unit 241-2 are capable of being separately controlled by the power source controller 242.

The power source controller 242 controls the second power source unit 241-2 such that the voltage applied to the grid 130 becomes a target value and controls the first power source unit 241-1 so that the voltage applied to the discharging part 120 to maintain the predetermined voltage difference from the voltage of the grid 130. In other words, the voltage of the grid 130 and the voltage of the discharging part 120 can be separately controlled using the power source controller 242.

Figure 8:
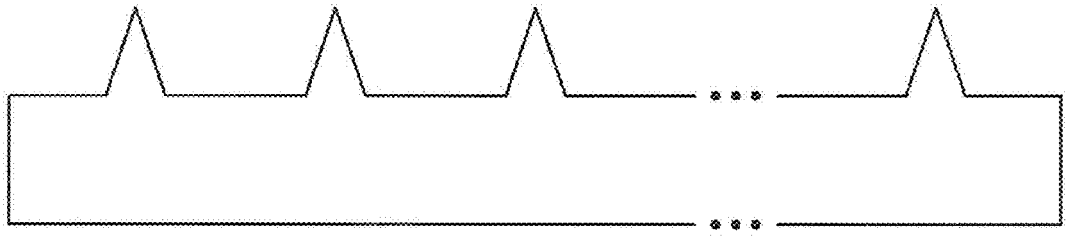
FIG. 8 to FIG. 10 are schematic perspective view provided to explain various types of discharging part usable in the charging device according several embodiments.
Figure 9:
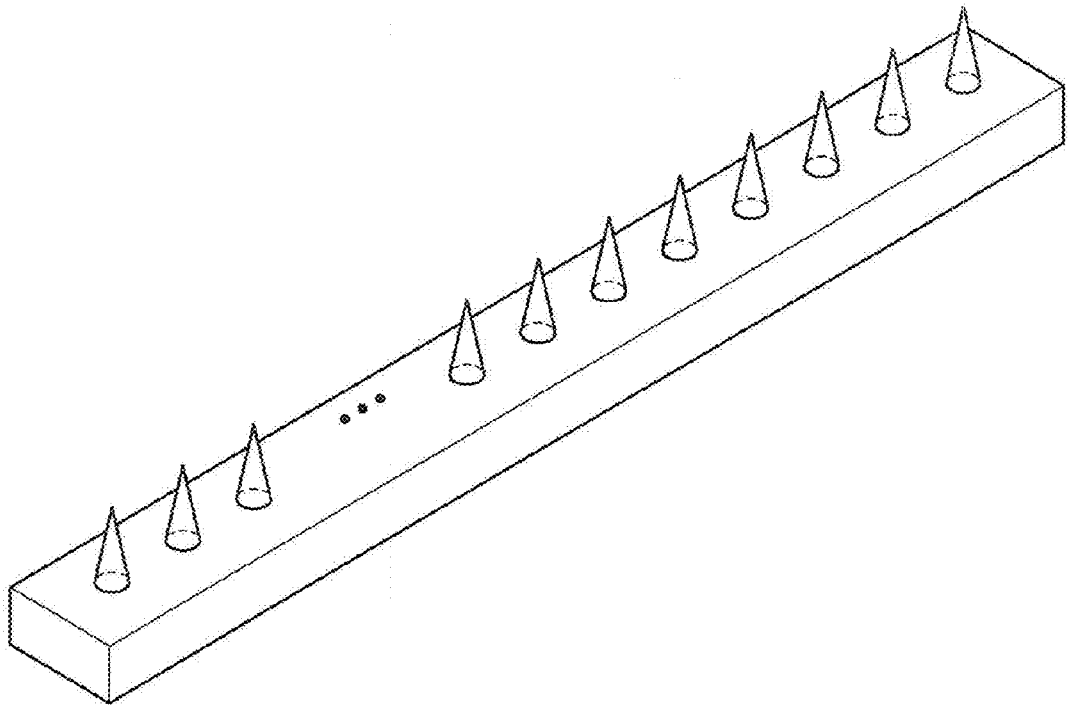
Figure 10:
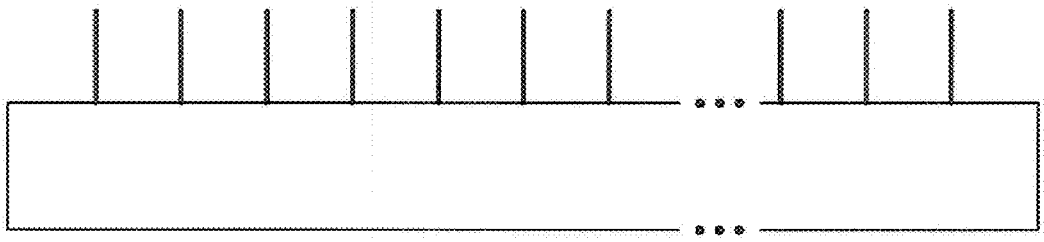

FIG. 8 to FIG. 10 are schematic perspective view illustrating various types of discharging part 120 usable in the charging device 100.

As illustrated in FIG. 8, the discharging part 120 may be implemented using a metal plate, one side surface of which containing one or more triangular pyramids. Accordingly, if voltage is applied to the metal plate, corona discharging may occur at the triangular pyramids.

As illustrated in FIG. 9, the discharging part 120 may be implemented as a metal bar, one side surface of which containing one or more cone shapes.

As illustrated in FIG. 10, the discharging part 120 may also be implemented using a metal plate, one side of which including one or more protrusions each in the form of a sharp pin, wire, or a bar.

As observed in several examples above, the discharging part 120 can be implemented using one or more pointed or sharp shapes in which corona discharging can occur.

Figure 11:
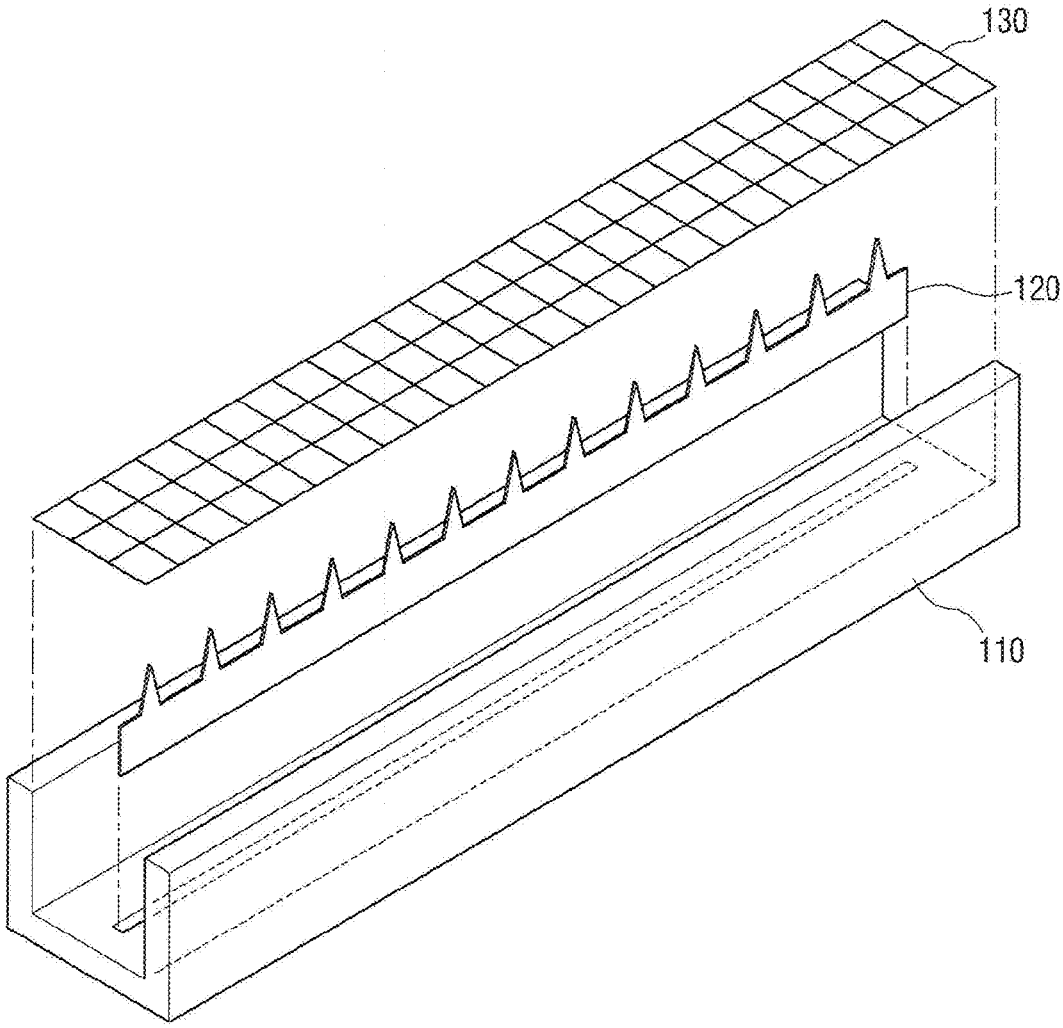
FIG. 11 is a three-dimensional schematic perspective view illustrating a charging device according to an embodiment.

FIG. 11 is a schematic perspective view illustrating a charging device according to an embodiment of the present invention. According to FIG. 11, the shield 110 may be formed with one side of the shield 110 being open. The side opposite the open side may be partially open and the discharging part 120 may be mounted on the partially open side. Once the discharging part 120 is mounted, the grid 130 may be mounted on the open side of the shield 110, resulting in the structure the charging device as shown in FIG. 1.

It is to be understood, however, the structure of charging device in FIG. 11 is merely an example, and that various other structures for the charging device may be possible in other alternative embodiments.

In the following description, the same drawing reference numerals are used for the same elements even in different drawings. The matters defined in the description, such as detailed construction and elements, are provided to assist in a comprehensive understanding of the invention. Thus, it is apparent that the present invention can be carried out without those specifically defined matters. Also, well-known functions or constructions are not described in detail since they would obscure the invention with unnecessary detail.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent-to those skilled in the art.

What is claimed is:

1. A charging device, comprising;

a shield;

a discharging part disposed inside the shield;

a grid disposed at an entrance of the shield; and a power supply unit configured to supply power to at least one of the discharging part and the grid such that a voltage difference between the discharging part and the grid remains substantially at a predetermined value and including a diode having one end connected to a node between the grid and ground, wherein the power supply unit includes:

a power source connected to the discharging part, and the diode, one end of which being connected to a first connection node between the discharging part and the power source unit, and the other end of which being connected to a second connection node between the grid and ground, the diode being configured to keep the predetermined voltage difference between the discharging part and the grid.

2. The charging device as claimed in claim 1, wherein the power supply unit includes:

a first power source connected to the grid;

a second power source connected to the discharging part; and a power source controller configured to control the first power source so that the voltage applied to the grid becomes a target value, the power source controller being further configured to control the second power source unit so that the voltage applied to the discharging part maintains the predetermined voltage difference from the voltage of the grid.

3. The charging device as claimed in claim 1, wherein the discharging part has a shape of one among wire, pin and saw teeth.

4. The charging device as claimed in claim 1, wherein the voltage difference between the discharging part and the grid is in a range of ±3.8 kV to ±6.0 kV.

5. The charging device as claimed in claim 1, wherein the electrical current of the discharging part is in a range of ±400 μA to ±2000 μA.

6. An image forming device, comprising;

a photoconductor; and a charging device configured to charge a surface of the photoconductor, the charging device comprising:

a shield, a discharging part disposed inside the shield, a grid disposed at an entrance of the shield spaced apart from the surface of photoconductor, and a power supply unit configured to supply power to at least one of the discharging part and the grid such that the grid has a first voltage corresponding to a second voltage of the surface of the photoconductor, and such that the discharging part and the grid has a predetermined voltage difference therebetween and including a diode having one end connected to a node between the grid and ground, wherein the power supply unit comprises:

a power source connected to the discharging part, and the diode, one end of which being connected to a first connection node between the discharging part and the power source unit, and the other end of which being connected to a second connection node between the grid and ground, the diode being configured to keep the predetermined voltage difference between the discharging part and the grid.

7. The image forming device as claimed in claim 6, wherein the power supply unit comprises:

a first power source connected to the discharging part;

a second power source connected to the grid; and a power source controller configured to control the first power source so that the voltage applied to the grid becomes a target value, the power source controller being further configured to control the second power source unit so that the voltage applied to the discharging part maintains the predetermined voltage difference from the voltage of the grid.

8. The image: forming device as claimed in claim 6, wherein the discharging part has shape of one among wire, pin and saw teeth.

9. The image forming device as claimed in claim 6, wherein the voltage difference between the discharging part and the grid is in a range of ±3.8 kV to ±6.0 kV.

10. The image forming device as claimed in claim 6, wherein the electrical current of the discharging part is in a range of ±400 μA to ±2000 μA.

* * * * *

UNITED STATES PATENT AND TRADEMARK OFFICE

CERTIFICATE OF CORRECTION

PATENT NO. : 8,055,149 B2
APPLICATION NO. : 12/481969
DATED : November 8, 2011
INVENTOR(S) : Jun-Suk Kwak It is certified that error appears in the above-identified patent and that said Letters Patent is hereby corrected as shown below:

Column 8, Line 30, In Claim 8, delete “image:” and insert -- image --, therefor.

Signed and Sealed this
Fourteenth Day of February, 2012

David J. Kappos

David J. Kappos
*Director of the United States Patent and Trademark Office*